US005520165A

United States Patent [19]

Khinkis et al.

[11] Patent Number: 5,520,165

[45] Date of Patent: May 28, 1996

[54] HYBRID DIRECT/INDIRECT WATER HEATING PROCESS AND APPARATUS

[75] Inventors: Mark J. Khinkis, Morton Grove; Hamid A. Abbasi, Darien; Roman E. Grosman, Lombard, all of Ill.

[73] Assignee: Institute of Gas Technology, Des Plaines, Ill.

[21] Appl. No.: 400,895

[22] Filed: Mar. 8, 1995

[51] Int. Cl.[6] ..... F24H 1/10

[52] U.S. Cl. ..... 126/355

[58] Field of Search ..... 126/355, 359

[56] References Cited

U.S. PATENT DOCUMENTS

| | | | |
|---|---|---|---|
| 2,169,683 | 8/1939 | Dunham et al. . | |
| 3,615,079 | 10/1971 | De Lara et al. . | |
| 3,648,682 | 3/1972 | Bougard . | |
| 3,826,240 | 7/1974 | Miyahara . | |
| 4,275,708 | 6/1981 | Wood . | |
| 4,530,347 | 7/1985 | Baker et al. . | |
| 4,658,803 | 4/1987 | Ball et al. . | |
| 4,686,940 | 8/1987 | Fullemann . | |
| 4,765,280 | 8/1988 | Kobayashi et al. . | |
| 5,086,731 | 2/1992 | Lockett et al. | 126/355 |

FOREIGN PATENT DOCUMENTS

| | | | |
|---|---|---|---|
| 143537 | 5/1961 | U.S.S.R. | 126/355 |

*Primary Examiner*—Carroll B. Dority
*Attorney, Agent, or Firm*—Speckman, Pauley & Fejer

[57] ABSTRACT

A hybrid direct/indirect liquid heater and a process for heating a liquid in which an unheated liquid is introduced into a direct contact chamber of a hybrid direct/indirect liquid heater where it is directly contacted with hot flue gases exhausted from a cyclonic combustor-heat exchanger. The unheated liquid in the direct contact chamber condenses any moisture in the hot flue gases, forming contaminated liquid droplets and the contaminated liquid droplets are introduced into an indirect heating chamber of the hybrid direct/indirect liquid heater where they are indirectly heated by contact with the exterior of the combustor-heat exchanger, forming heated contaminated liquid. Gaseous contaminants are separated from the heated contaminated liquid, forming decontaminated liquid which is accumulated in a hot liquid storage.

20 Claims, 2 Drawing Sheets

HYBRID DIRECT/INDIRECT WATER HEATING PROCESS AND APPARATUS

BACKGROUND OF THE INVENTION

1. Field of the Invention

This invention relates to a process and apparatus for heating a liquid, including water, by using combined direct and indirect heat transfer between hydrocarbon fuel combustion products and the liquid being heated. The process and apparatus of this invention for heating water provide high thermal efficiencies at liquids, including water, temperatures up to about 210° F., ultra-low pollutant air emissions, as well as hot water with very low levels of contaminants.

2. Description of the Prior Art

Processes and apparatuses for heating water in which flue gases from an indirect heating section pass through a direct contact section of a water heater into which water to be heated is introduced and in which heated water from the direct contact section flows into an indirect heating section, where the indirect heating section comprises the combustion apparatus for heating of water in the indirect heating section, are taught by the prior art. One known device produces water heated to a temperature of up to about 203° F.; however, the heated water contains significant amounts of gaseous and liquid contaminants and the device emits high levels of air pollutant emissions.

Ball et al., U.S. Pat. No. 4,658,803, teaches a compact, gas-fired water heater in which water is indirectly heated by a gas burner-fired immersion tube and directly heated by mutual contact between the hot flue gases from the immersion tube outlet and feed water droplets introduced into a direct contact section disposed above the immersion tube as they pass each other in a counter flow arrangement through apertures in a plurality of plates and through a packed bed of grated solid particles.

Similarly, Baker et al., U.S. Pat. No. 4,530,347, teaches a compact gas-fired water heater in which water is indirectly heated by a gas burner-fired immersion tube and directly heated by contact between the hot flue gases from the immersion tube outlet and cold feed water droplets introduced into a direct contact section disposed above the indirect contact section as they pass each other in contraflow through apertures in a plurality of plates.

Wood, U.S. Pat. No. 4,275,708, teaches a direct contact, water heating column furnace for producing heated water having a body and a grid dividing the interior of the body into upper and lower compartments. The upper compartment contains heat absorbing material into which cold water is introduced. The lower compartment forms a combustion chamber and reservoir for storage of hot water heated in the apparatus. The combustion products from the combustion chamber rise through the heat absorbing material to heat the cold water which, in turn, flows around the combustion chamber into the lower compartment.

C. A. Dunham et al., U.S. Pat. No. 2,169,683, teaches an apparatus for producing a heating medium consisting of a highly saturated mixture of steam and hot products of combustion for use in a heating system, the apparatus consisting of a closed housing which is confined in a combustion chamber surrounded at the sides and top by a body of water so that all of the heat not retained by the products of combustion is absorbed by the water. A mixing chamber is disposed above the combustion chamber into which water is sprayed to provide contact with the combustion gases from the combustion chamber, producing a highly saturated mixture. Water condensing therefrom is returned to the water surrounding the combustion chamber.

Devices for heating water employing direct contact heat transfer only and conventional combustion processes are also known. Such designs generally provide thermal efficiencies in excess of 95%, but only heat the water to about 160° F.

Direct contact water heating is also taught by G. C. De Lara et al., U.S. Pat. No. 3,615,079, which discloses a heat exchanger in which a gas and liquid heat carrier are brought into direct contact by the bubbling of the gas in the liquid heat carrier to effect an exchange of heat therebetween and utilizing the bubbling action of the gas in the liquid heat carrier to effect circulation of the liquid heat carrier.

Miyahara, U.S. Pat. No. 3,826,240, teaches a direct contact water heater comprising a body and lattice-like partition plate dividing the interior of the body into an upper heat absorbing chamber and a lower combustion chamber. Combustion products from the lower combustion chamber flow upward into the heat absorbing chamber into which cold water is supplied. A plurality of heat absorbing members are disposed in the heat absorbing chamber and the cold water is supplied onto the heat absorbing members.

Bougard, U.S. Pat. No. 3,648,682, teaches a direct contact water heater in which the liquid to be heated is introduced into the top of a column and distributed in a downward flow through the column. A combustion chamber closed on the top and sides thereof, but open on the bottom, is disposed within the column. Combustion gases produced in the combustion chamber flow through the open bottom of the chamber and upwardly through an annular space, whereby the gases come in contact with the downward flowing liquid to which heat from the combustion gases is transferred.

Lockett et al., U.S. Pat. No. 5,086,731, teaches a gas-fired, direct contact water heater in which the heated water from a lower part of the heater is removed through an outlet conduit. To replace the removed water, water to be heated is sprayed into an upper part of the heater above a heat transfer means through which passes the downward flowing water and upward flowing products of combustion from a combustion chamber disposed in the lower part of the water heater, resulting in heating of the downward flowing water.

Kobayashi et al., U.S. Pat. No. 4,765,280, teaches a direct contact water heater in which the water introduced into the top of the heater flows down along the surrounding sidewalls of a high temperature gas feed chamber in the form of a water film without coming down into the gas feed chamber.

Fullemann, U.S. Pat. No. 4,686,940, teaches an indirect contact device for heating a fluid and cleaning a waste gas comprising a container into which waste gas and an atomized liquid are introduced. A heat exchanger is disposed in a chamber for transferring heat between the waste gas in the container and a liquid to be heated.

As previously indicated, the direct contact of water with combustion products for heating the water in accordance with known water heating devices results in the transfer of substantial gaseous contaminants from the combustion products to the water during the operation of such devices. Thus, water produced by such devices may contain high levels of undesirable gaseous and liquid contaminants. Additionally, pollutants which are not absorbed by the water are exhausted together with other combustion products, thereby emitting high levels of pollutants into the atmosphere. Furthermore, although devices which can achieve high thermal efficiencies at low water temperatures are taught by the prior art, we are unaware of devices which can produce high temperature water, approximately 210° F., at high thermal efficiencies, that is, greater than about 95%.

SUMMARY OF THE INVENTION

It is an object of this invention to provide a combined direct/indirect heating process and apparatus for heating a liquid which produces ultra-low air pollutant emissions.

It is an object of this invention to provide a combined direct/indirect heating process and apparatus for heating a liquid which produce a hot liquid with very low levels of gaseous, liquid and other contaminants.

It is another object of this invention to provide a combined direct/indirect heating process and apparatus which effectively destroys the organic contaminants in the combustion air and minimize their transmission the water.

It is an object of this invention to provide a combined direct/indirect heating process and apparatus for heating a liquid which has a minimal corrosive effect on pipelines and other equipment that may come in contact with the heated liquid.

It is another object of this invention to provide a combined direct/indirect heating process and apparatus for heating water to temperatures of up to at least 210° F. with thermal efficiencies of 95% or greater.

It is another object of this invention to provide a combined direct/indirect heating process and apparatus for heating water suitable for human use and consumption (potable water).

These and other objects of this invention are achieved by a hybrid direct/indirect liquid heater in accordance with one embodiment of this invention comprising direct contact means for directly heating an unheated liquid, ultra-low emission combustion means for cyclonically burning a fuel and oxidant, said ultra-low emission combustion means comprising a hot flue gas exhaust in communication with the direct contact means, and indirect heating means for indirectly heating heated contaminated liquid from the direct contact means. The indirect means are in thermal communication with said ultra-low emission combustion means and in fluid communication with said direct contact means.

The process for heating a liquid, preferably water, according to this invention comprises introducing an unheated liquid into a direct contact section of a liquid heater. A fuel and an oxidant are burned in an ultra-low emission combustor-heat exchanger, preferably a premix cyclonic combustor-heat exchanger, forming hot flue gases. The hot flue gases are exhausted from the ultra-low emission combustor-heat exchanger and contact the unheated liquid in the direct contact section, forming contaminated liquid droplets comprising gaseous contaminants or inclusions. The contaminated liquid droplets are introduced into an indirect heating, boiling and decontamination section of the liquid heater comprising the ultra-low emission combustor-heat exchanger, where the contaminated liquid droplets are heated, forming heated contaminated liquid. Subsequently, gaseous contaminants are separated from the heated contaminated liquid, forming separate gaseous contaminants and heated decontaminated liquid. The decontaminated liquid is then accumulated in a hot liquid storage.

A critical feature of the process and apparatus of this invention is the ultra-low emission combustor-heat exchanger, the combustion process of which produces ultra-low levels of nitrogen oxides and other emissions that may contaminate the heated liquid. In accordance with the process of this invention for heating a liquid, a fuel and oxidant, preferably premixed, are tangentially injected into the combustion chamber of the ultra-low emission combustor-heat exchanger, thereby imparting a swirl or a cyclonic flow pattern to the fuel/oxidant mixture, resulting in strong internal combustion products recirculation. This recirculation characteristic allows the ultra-low emission combustor-heat exchanger to achieve ultra-low emissions of nitrogen oxides and other pollutants as well as very high combustion efficiency. The ultra-low emission combustor-heat exchanger also effectively destroys organics in the combustion air. Consequently, the hot flue gases exhausted from the ultra-low emission combustor-heat exchanger which contact the unheated liquid in the direct contact section of the liquid heater of this invention contain ultra-low levels of pollutants, reducing the potential for contamination of the unheated liquid.

In accordance with one preferred embodiment of the process of this invention, single stage cyclonic combustion with diluent addition is employed. Preferred diluents are water, steam, recirculated flue gases, excess air, and mixtures thereof. In accordance with another embodiment of the process of this invention, two-stage cyclonic combustion, with or without diluent addition, is employed.

Another critical feature of the process and apparatus of this invention is the separation of gaseous contaminants that are transferred to the heated liquid from the hot flue gases, thereby further reducing the level of contaminants in the hot liquid. In accordance with one embodiment of the process of this invention for heating water, the heated contaminated water from the direct contact section of the water heater is collected in the indirect section of the water heater and boiled to produce steam, separate gaseous contaminants and heated decontaminated water. The heated decontaminated water is discharged from the indirect heating section of the water heater and accumulated in a hot water storage.

BRIEF DESCRIPTION OF THE DRAWINGS

The above mentioned and other features of this invention and the manner of obtaining them will become more apparent, and this invention itself will be better understood by reference to the following description of specific embodiments of this invention taken in conjunction with the accompanying drawings, in which.

DESCRIPTION OF PREFERRED EMBODIMENTS

It will be apparent to those skilled in the art that the process and apparatus of this invention are suitable for heating a wide range of liquids. Accordingly, although this detailed description discusses a preferred embodiment of the process and apparatus of this invention as a water heater, there is no intention to limit the process and apparatus of this invention to heating only water.

Figure 1:
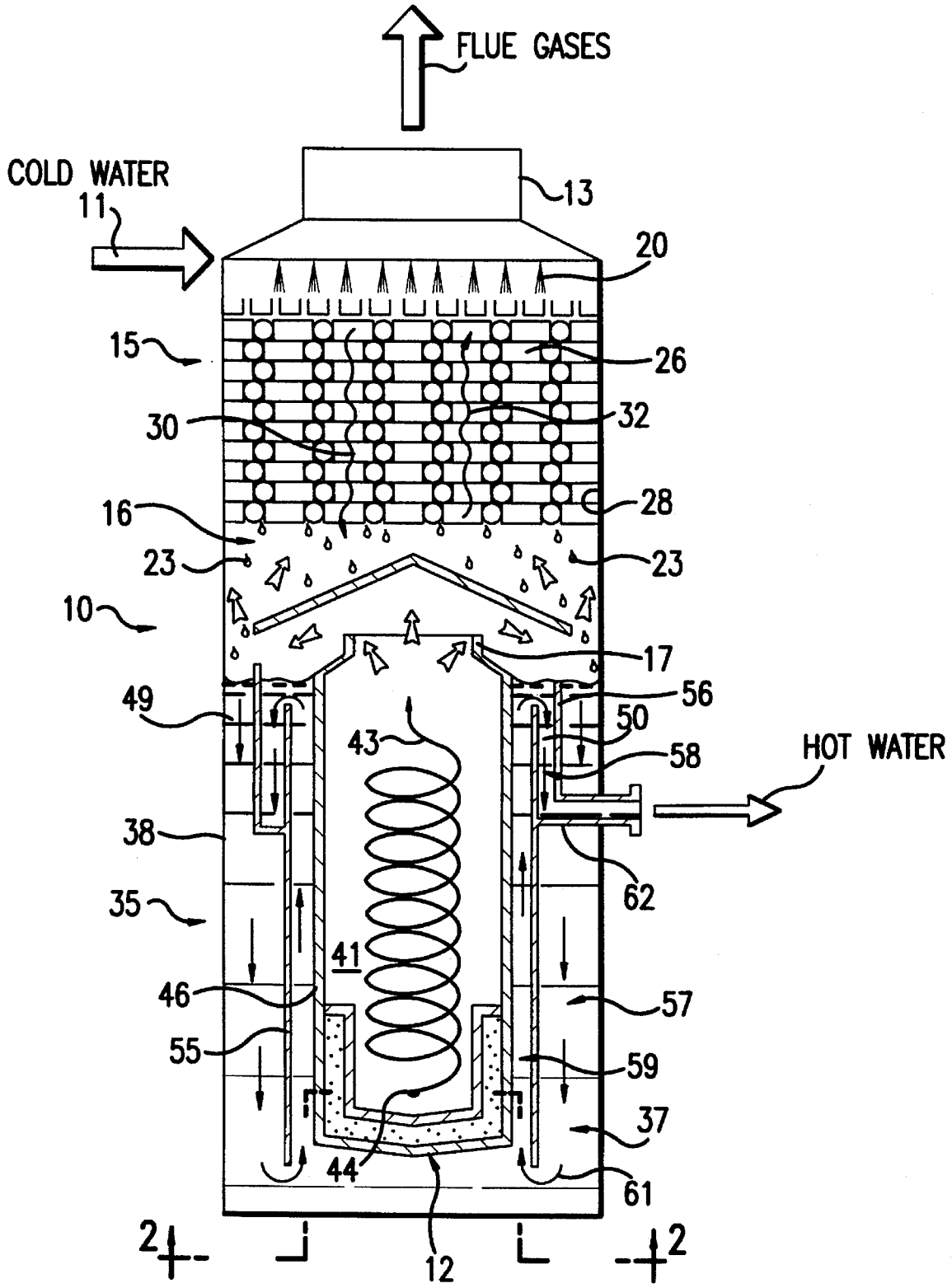
FIG. 1 is conceptual a cross-sectional view of the hybrid direct/indirect liquid heater in accordance with one embodiment of this invention.

FIG. 1 illustrates hybrid direct/indirect water heater 10 in accordance with one embodiment of this invention. Hybrid direct/indirect water heater 10 comprises direct contact means for directly heating cold water, cyclonic combustion means, preferably premix cyclonic combustion means, for cyclonically burning a fuel and oxidant, and indirect heating means for indirectly heating heated contaminated water from said direct contact means. Said direct contact means comprises direct contact section 15, said cyclonic combustion means comprises cyclonic combustor 12 and said indirect heating means comprises indirect heating section 35. Cyclonic combustor 12 comprises hot flue gas exhaust 17 which is in fluid communication with said direct contact section 15. Indirect heating section 35 is in thermal communication with cyclonic combustor 12 and in fluid communication with direct contact section 15.

In accordance with one embodiment of this invention, direct contact section 15 comprises direct contact chamber wall 28 which defines direct contact chamber 16 and cold water inlet means 11 for introducing cold water into direct contact chamber 16. Indirect heating section 35 comprises indirect heating chamber wall 38 which defines indirect heating chamber 37. Disposed within indirect heating chamber 37 is cyclonic combustor 12 by which heat from the combustion therein is transferred to heated contaminated water 49 disposed within indirect heating chamber 37 and in contact with the exterior of cyclonic combustor 12.

Direct contact section 15 further comprises packed column 26 disposed in direct contact chamber 16. Cold water introduced into direct contact chamber 16 through cold water inlet means 11 is directed through packed column 26. As shown in FIG. 1, cold water spray nozzles 20 spray cold water over packed column 26, which may have more than one stage, and, in conjunction with direct contact chamber wall 28, direct the cold water through packed column 26.

Figure 2:
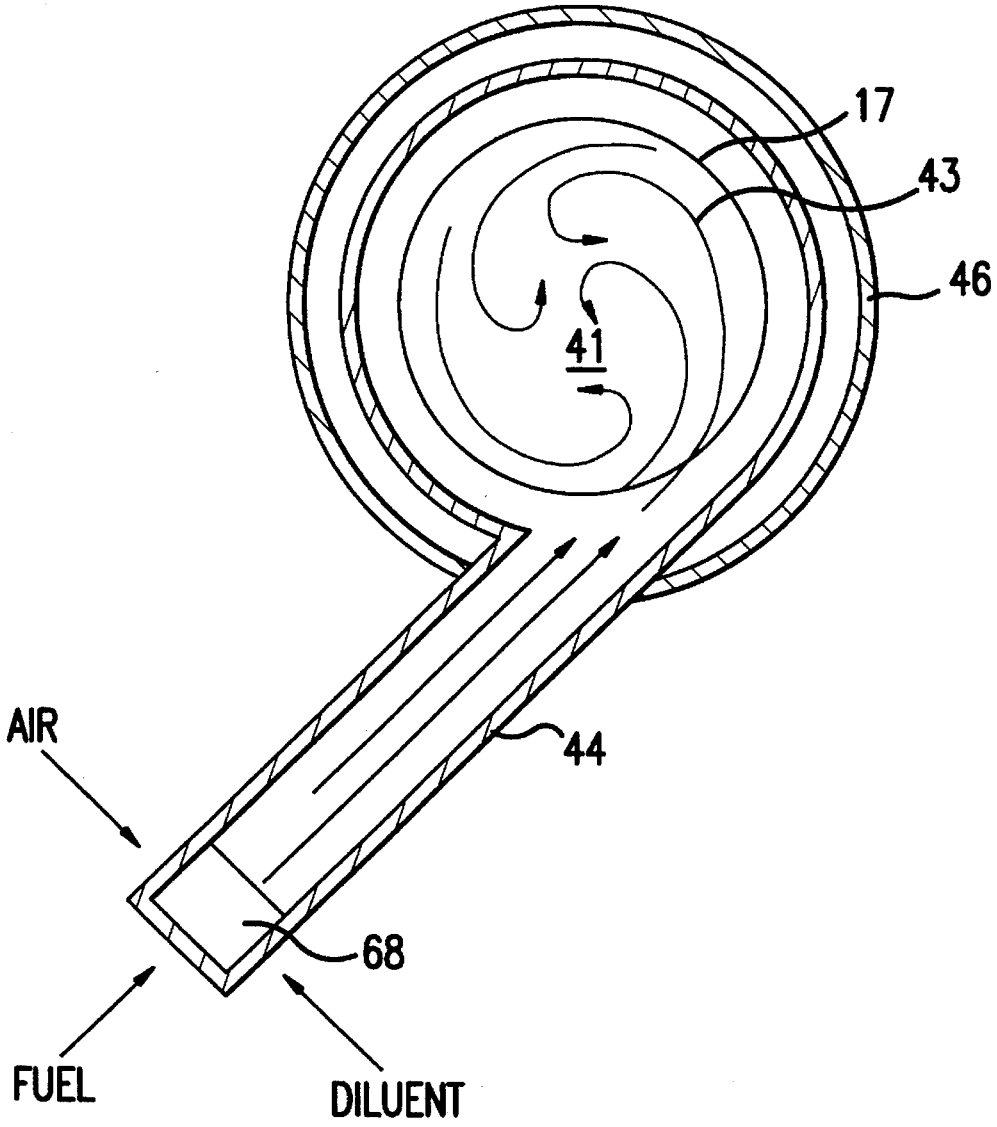
FIG. 2 is a cross-sectional view of a premix cyclonic combustor-heat exchanger for a hybrid direct/indirect liquid heater taken along line 2—2, as shown in FIG. 1, in accordance with one embodiment of this invention.

In accordance with one preferred embodiment of this invention, cyclonic combustor 12 comprises combustor chamber wall 46 defining a substantially cylindrical, longitudinally extending combustor chamber 41. As shown in FIG. 1, cyclonic combustor 12 is disposed beneath packed column 26 in indirect heating section 35, whereby hot flue exhaust 17 of cyclonic combustor 12 is in fluid communication with direct contact chamber 16. Cyclonic combustor 12 further comprises tangential injection means for tangentially injecting a fuel and oxidant into combustor chamber 41 secured to combustor chamber wall 46. As used throughout the specification and claims, "tangential injection" refers to injection in a non-radial manner so as to generate a cyclonic flow generally around a centerline of the combustor chamber. In accordance with another preferred embodiment of this invention, cyclonic combustor 12 further comprises means for introducing water and/or flue gases into combustor chamber 41. Accordingly, as shown in FIG. 2, connected to combustion chamber wall 46 and in fluid communication with combustion chamber 41 is tangential injection nozzle 44 which is connected to fuel/oxidant/diluent mixing means 68 for mixing and injecting an oxidant such as air, a fuel, preferably natural gas, and diluents, such as flue gases from flue gas exhaust 13, water, or steam into combustion chamber 41 through tangential injection nozzle 44. It will be apparent to those skilled in the art that water, steam, recirculated flue gases and the like may be introduced into cyclonic combustion chamber 41 other than mixed with fuel and/or oxidant introduced through tangential injection nozzle 44.

In accordance with one embodiment of this invention, as shown in FIG. 1, heat exchange means for heating contaminated water droplets 23 from direct contact section 15 in indirect heating section 35 comprises combustion chamber 41 disposed within indirect contact chamber 37. Furthermore, hybrid direct/indirect water heater 10 of the embodiment of this invention shown in FIG. 1 comprises circulation means for circulating heated contaminated water 49 comprising contaminated water droplets 23 within indirect heating chamber 37 to contact combustion chamber wall 46. Said circulation means comprises first partition 55 positioned between indirect heating chamber wall 38 and combustion chamber wall 46, forming first annular space 57 between indirect heating chamber wall 38 and first partition 55. Second annular space 59 is formed between first partition 55 and combustion chamber wall 46. Second partition 56 is disposed between a portion of first partition 55 and indirect heating chamber wall 38 forming annular chamber 58 between second partition 56 and combustion chamber wall 46 and in communication with second annular space 59. Hybrid direct/indirect water heater 10 further comprises hot water removal means for removing water from annular chamber 58 to a hot water storage, which, in accordance with one embodiment of this invention, as shown in FIG. 1, comprises discharge conduit 62 connected to second partition 56 and first partition 55, and extending through indirect heating chamber wall 38.

A process for heating water according to this invention comprises introducing cold water into direct contact chamber 16 of direct contact section 15 of hybrid direct/indirect water heater 10, through spray nozzles 20 over packed column 26, causing the cold water to cascade in the direction designated by arrow 30 through packed column 26 towards indirect heating chamber 37. An oxidant, preferably air, is premixed with a fuel, preferably natural gas, forming a fuel/oxidant mixture and the fuel/oxidant mixture is burned in cyclonic combustor 12, forming hot flue gases. As shown in FIG. 2, fuel and oxidant are mixed by fuel/oxidant/diluent means 68 and injected through tangential injection nozzle 44 into combustion chamber 41, thereby imparting swirling pattern 43 to combustion gases in combustion chamber 41 of cyclonic combustor 12, shown in FIG. 1. The hot flue gases are exhausted from cyclonic combustor 12 through hot flue gas exhaust 17 into direct contact chamber 16 where they contact the cold water. The hot flue gases then pass through packed column 26 in the direction designated by arrow 32 which is countercurrent to the direction of cold water flow. In one process for producing hot water according to this invention, the hot flue gases heat the cold water in packed column 26 to a temperature of up to 185° F. and the hot flue gases are cooled to a temperature below 100° F. The cooled flue gases are then exhausted from hybrid direct/indirect water heater 10 through cooled flue gas exhaust 13.

The cold water flowing through packed column 26 condenses any moisture in the hot flue gases and forms contaminated water droplets 23 which comprise gaseous contaminants from the hot flue gases. Contaminated water droplets 23 are introduced into indirect heating section 35 of hybrid direct/indirect contact water heater 10, where contaminated water droplets 23 are accumulated in indirect heating chamber 37 and heated by cyclonic combustor 12, forming heated contaminated water 49. Gaseous contaminants are then separated from heated contaminated water 49 by boiling the heated contaminated water 49, forming separate gaseous contaminants and heated decontaminated water 50. Decontaminated water 50 is then discharged from indirect heating section 35 and accumulated in a hot water storage.

In one process for producing hot water according to this invention, heated contaminated water 49 is circulated within indirect heating chamber 37 as shown by arrow 61, as shown in FIG. 1. Convection currents may assist in the circulation of heated contaminated water 49 in indirect heating chamber 37. Combustion chamber wall 46 and first partition 55 provide large surface areas along which stable thin film flow of heated contaminated water 49 is induced, resulting in high heat transfer coefficients, boiling of the thin film and thermal deaeration of heated contaminated water 49, reducing the corrosive effect of heated contaminated water 49 on pipelines and other equipment that may come in contact with heated contaminated water 49. Intense heating and convection currents in indirect heating section 35 promote boiling of heated contaminated water 49 to produce steam and to release separate gaseous contaminants from heated contaminated water 49, producing heated decontaminated water 50 at temperatures of up to 210° F.

In accordance with one embodiment of the process for producing hot water according to this invention, water is injected into combustion chamber 41, forming water vapor. The water injected into combustion chamber 41 absorbs heat and reduces peak flame temperatures within combustion chamber 41 which assists in reducing the emission of nitrogen oxides from cyclonic combustor 12. Conventional combustion processes which inject water into a combustion chamber to reduce the emission of nitrogen oxides exhaust the water vapor formed in the combustion chamber directly into the atmosphere, thereby decreasing thermal efficiencies of the processes. In accordance with one embodiment of the process of producing hot water according to this invention, the water vapor is exhausted into direct contact section 15 where the water vapor is condensed by the cold water and returned to indirect heating section 35, thereby conserving heat and maintaining a very high level of thermal efficiency.

In accordance with another embodiment of the process for producing hot water according to this invention, flue gases from direct contact section 15 are recirculated to combustion chamber 41 to further reduce the emission of nitrogen oxides. Other techniques for reducing the emission of nitrogen oxides such as high excess air firing and staged combustion may be utilized as well.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A hybrid direct/indirect liquid heater comprising:

direct contact means for directly heating a liquid;

cyclonic combustion means for cyclonically burning a fuel and oxidant, said cyclonic combustion means comprising a hot flue gas exhaust in fluid communication with said direct contact means; and indirect heating means for indirectly heating a heated liquid from said direct contact means, said indirect heating means in thermal communication with said cyclonic combustion means and in fluid communication with said direct contact means.

2. A hybrid direct/indirect liquid heater in accordance with claim 1, wherein said direct contact means comprises a direct contact chamber wall defining a direct contact chamber, and liquid inlet means for introducing said liquid into said direct contact chamber.

3. A hybrid direct/indirect liquid heater in accordance with claim 2, wherein said direct contact means further comprises a packed column disposed in said direct contact chamber.

4. A hybrid direct/indirect liquid heater in accordance with claim 3, wherein said liquid inlet means comprises means for directing said liquid through said packed column.

5. A hybrid direct/indirect liquid heater in accordance with claim 1, wherein said cyclonic combustion means comprises a combustion chamber wall defining a substantially cylindrical, longitudinally extending combustion chamber and tangential injection means for tangentially injecting said fuel and oxidant into said combustion chamber secured to said combustion chamber wall.

6. A hybrid direct/indirect liquid heater in accordance with claim 5, wherein said indirect heating means comprises an indirect heating chamber wall defining an indirect heating chamber and heat exchange means for indirectly heating said heated liquid.

7. A hybrid direct/indirect liquid heater in accordance with claim 6, wherein said heat exchange means comprises said combustion chamber disposed within said indirect heating chamber.

8. A hybrid direct/indirect liquid heater in accordance with claim 7 further comprising circulation means for circulating said heated liquid within said indirect heating chamber to contact said combustion chamber wall.

9. A hybrid direct/indirect liquid heater in accordance with claim 8 wherein said circulation means comprises a first partition positioned between said indirect heating chamber wall and said combustion chamber wall forming a first annular space between said indirect heating chamber wall and said first partition and a second annular space between said first partition and said combustion chamber wall, said first partition disposed at a distance from a bottom of said indirect heating chamber.

10. A hybrid direct/indirect liquid heater in accordance with claim 9, wherein said circulation means further comprises a second partition secured to said first partition and disposed between a portion of said first partition and said indirect heating chamber wall forming an annular chamber between said first partition and said second partition and hot water removal means for removing water from said annular chamber.

11. A hybrid direct/indirect liquid heater in accordance with claim 5, wherein said cyclonic combustion means further comprises means for introducing at least one of water and flue gases into said combustion chamber.

12. A process for heating a liquid comprising:

introducing an unheated said liquid into a direct contact section of a liquid heater;

burning a fuel and oxidant in a cyclonic combustor-heat exchanger disposed within an indirect heating section of said liquid heater, forming hot flue gases;

exhausting said hot flue gases from said cyclonic combustor-heat exchanger;

contacting said liquid with said hot flue gases, forming contaminated liquid droplets comprising gaseous contaminants in said direct contact section;

introducing said contaminated liquid droplets into said indirect heating section of said liquid heater, thereby contacting an exterior of said cyclonic combustor-heat exchanger with said contaminated liquid droplets, forming a heated contaminated liquid;

separating said gaseous contaminants from said heated contaminated liquid in said indirect heating section, forming separate gaseous contaminants and heated decontaminated liquid; and accumulating said heated decontaminated liquid in a hot liquid storage.

13. A process for heating a liquid in accordance with claim 12, wherein said liquid is water.

14. A process for heating a liquid in accordance with claim 12, wherein said unheated liquid and said hot flue gases flow through a packed column disposed in said direct contact section of said liquid heater.

15. A process for heating a liquid in accordance with claim 14, wherein said hot flue gases heat said unheated liquid to a temperature of up to about 185° F.

16. A process for heating a liquid in accordance with claim 14, wherein said hot flue gases are cooled by contact with said unheated liquid to a temperature below about 100° F.

17. A process for heating a liquid in accordance with claim 16, wherein water is injected into a combustion chamber of said cyclonic combustor-heat exchanger, forming water vapor.

18. A process for heating a liquid in accordance with claim 17, wherein said gaseous contaminants are separated from said heated contaminated liquid by boiling said heated contaminated liquid to produce a liquid vapor.

19. A process for heating a liquid in accordance with claim 12, wherein flue gases from said direct contact section are recirculated to a combustion chamber of said cyclonic combustor-heat exchanger.

20. A process for heating a liquid in accordance with claim 12, further comprising combusting said fuel and oxidant in stages.

* * * * *